United States Patent [19]

Mewissen

[11] Patent Number: 4,678,959

[45] Date of Patent: Jul. 7, 1987

[54] DEVICE FOR COOLING THE PINCH SEAL OF AN ELECTRIC LAMP, AND AN ELECTRIC LAMP AND AN IRRADIATION APPARATUS PROVIDED WITH THIS COOLING DEVICE

[75] Inventor: Jan A. C. Mewissen, Eindhoven, Netherlands

[73] Assignee: U.S. Philips Corporation, New York, N.Y.

[21] Appl. No.: 791,676

[22] Filed: Oct. 28, 1985

[30] Foreign Application Priority Data

Nov. 15, 1984 [NL] Netherlands ..... 8403486

[51] Int. Cl.[4] ..... H01J 7/24; H01J 1/34; H01K 1/58

[52] U.S. Cl. ..... 313/17; 313/25; 313/43; 313/623; 313/315; 362/373

[58] Field of Search ..... 313/17, 25, 39, 40, 313/41, 43, 44, 45, 46, 623, 315, 332; 362/373

[56] References Cited

U.S. PATENT DOCUMENTS

| | | | |
|---|---|---|---|
| 687,883 | 12/1901 | Hewitt | 313/43 X |
| 3,333,132 | 7/1967 | Edris et al. | 313/17 |
| 3,602,761 | 8/1971 | Kimball et al. | 313/43 X |
| 3,983,385 | 9/1976 | Troue | 313/43 X |

*Primary Examiner*—David K. Moore
*Assistant Examiner*—K. Wieder
*Attorney, Agent, or Firm*—David R. Treacy

[57] ABSTRACT

The pinch seal (12) of an electric lamp (11) is kept during operation at a lower temperature by a metal envelope (10), space between this metal envelope (10) and faces of the pinch seal (12) being filled with a heat-conducting mass comprising metal fibers. A considerable temperature decrease is obtained when the spaces between the oppositely arranged major surfaces (13) of the pinch seal (12) and the metal envelope (10) are filled with metal fibers.

21 Claims, 3 Drawing Figures

DEVICE FOR COOLING THE PINCH SEAL OF AN ELECTRIC LAMP, AND AN ELECTRIC LAMP AND AN IRRADIATION APPARATUS PROVIDED WITH THIS COOLING DEVICE

The invention relates to a device for cooling a pinch seal of an electric lamp. The lamp comprises a lamp vessel having a pinch seal with two oppositely arranged major faces, at least one current supply conductor extending through this pinch seal to an electric element arranged in the lamp vessel. The device comprises a metal envelope for the pinch seal and a heat-conducting mass for filling space between the pinch seal and the metal envelope. An electric infrared incandescent lamp comprises such a device, and an infrared irradiation apparatus having such a lamp are known from British Patent Specification 1,498,340 corresponding to U.S. Pat. No. 4,069,437.

Electric infrared lamps can be used for various applications, such as agricultural and industrial applications, for example in ovens or tunnels, or for drying inks and lacquers. Another application is electric cooking. Where infrared lamps, halogen incandescent lamps and discharge lamps are used in a lamp container of limited size, there is a risk of a pinch seal of the lamps assuming an excessively high temperature, as a result of which cracks occur in the pinch seal. Numerous teaching in the prior art are known for dissipating heat from the pinch seal. Particularly, it is well-known in the prior art to enclose the pinch seal by a metal sleeve. However, it has been found that this measure can result in an increase rather than in a decrease of the temperature of the pinch seal.

It is known from the British Patent Specification mentioned in the opening paragraph that the temperature of the pinch seal is considerably lower when the space between a metal sleeve and the pinch seal is filled by a thermally conducting cement. A disadvantage of this construction, however, is that it is rather complicated and hence rather expensive.

The invention has for its object to provide a device for cooling the pinch seal of an electric lamp, which has a very simple construction and nevertheless is very effective.

According to the invention, this object is achieved in a device of the kind described in the opening paragraph, in that the thermally conducting mass comprises metal fibers.

It has been found that metal fibers can ensure a very good thermally conducting contact between the pinch seal and its metal envelope, as a result of which very low pinch seal temperatures are obtained.

The metal fibers can be used in various forms such as strands, a braided ribbon or a braided sleeve, a fabric, a knitted structure or a felt. Forms in which the metal fibres have a mutual coherence, have the advantage that measured quantities thereof can be readily manipulated and that, when the device is opened, the mass of fiber remains more accurately in place.

The major faces at the pinch seal are usually considerably larger than the minor surfaces. The major surfaces then form the major part of the surface area of the pinch seal. Thus sufficient thermal conduction results when fibers are provided in the space between the major faces of the pinch seal and the metal envelope.

The metal fibers can be loosely present in the metal envelope or can be fixed therein. For example, in view of the low temperatures of the pinch, fixing means includes glue, local clamping, or one or more welding connections.

Various metals can be used for the metal fiber, such as iron, steel, copper, aluminium.

The device for cooling the pinch seal of a lamp is detachably connected to both a lamp and an irradiation arrangement. In an alternative embodiment, the device is undetachably connected to a lamp as a lamp base. In another alternative embodiment the device is secured as a lamp holder in an irradiation apparatus. This embodiment affords the advantage that the lamps used in this irradiation apparatus have a simpler construction, i.e. have a bare pinch seal.

An electric lamp can comprise a filament as the electric element or a pair of electrodes in an ionizable medium. The lamp has two pinch seals each having a current supply conductor, each having a device for cooling, or each being accommodated in such a device. The lamp also comprises one pinch seal through which both current supply conductors are passed.

Embodiments of the invention will now be described, by way of example, with reference to the accompanying drawing.

Figure 1:
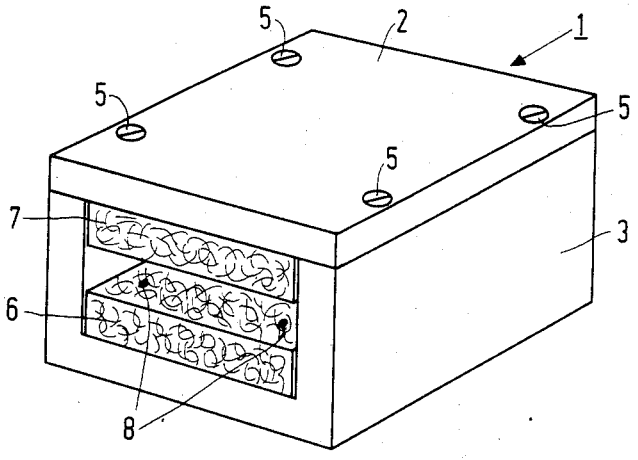
FIG. 1 is a perspective view of the cooling device according to the invention.

The device 1 for cooling a pinch seal of an electric lamp shown in FIG. 1 has a metal envelope consisting of cover part 2 and bottom part 3. The cover part 2 and the bottom part 3 are detachably secured to each other by means of screws 5.

Metal fibers are arranged in the envelope. In an embodiment shown in FIG. 1, these fibers are steel fibers which, are meshed with each other to form felt members 6 and 7, each fixed in the envelope by means of welds 8.

Figure 2:
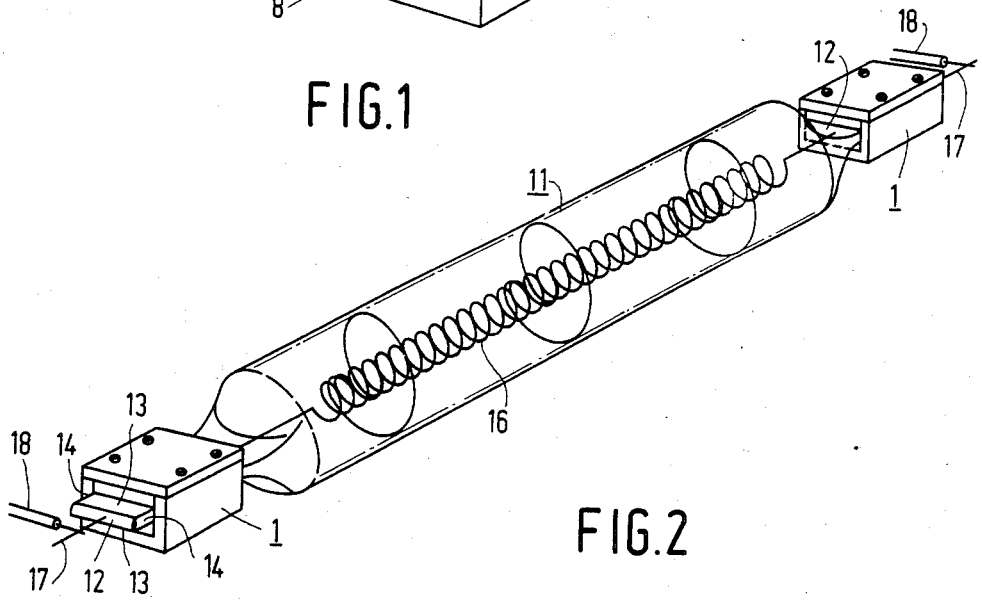
FIG. 2 is a perspective view of an electric lamp according to the invention.

The electric lamp shown in FIG. 2 has a lamp envelope 11 with pinch seals 12, which each have two oppositely arranged major faces 13 and two oppositely arranged minor faces 14. A filament 16 is stretched as an electric element in the lamp vessel 11 between current supply conductors 17. Each conductor is passed through a respective pinch seal 12. A respective cable 18 is electrically connected to the current supply conductors 17.

A respective cooling device 1 is provided on both pinch seals 12. As shown in both FIGS. 1 and 2, the spaces between the major faces 13 of the pinch seals 12 and the metal envelope are filled by the metal fibers 6 and 7. As a result of this arrangement the major part of the surface area of the pinch seals 12 is in very good thermal contact with the metal envelope.

Figure 3:
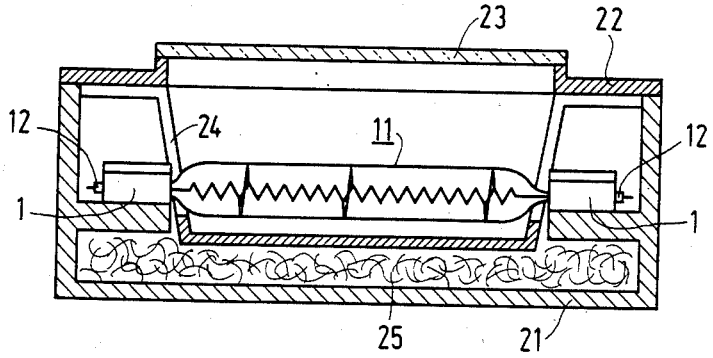
FIG. 3 is a sectional view of an irradiation apparatus according to the invention.

In FIG. 3, the irradiation apparatus has a housing comprising a bottom part 21 and cover parts 22 and 23. The housing accommodates a reflector 24 and thermally isolating material 25. Cooling devices 1 as shown in FIG. 1 are secured to the housing and the bare pinch seals 12 of the lamp of FIG. 2 are detachably arranged in these devices. The cover part 23 is made of glass-ceramic material transmitting infrared radiation, as a result of which the irradiation apparatus is suitable to be used as an electric cooking apparatus.

The cooling device according to the invention was shown by experiments to produce an excellent cooling effect.

For example, an infrared incandescent lamp according to the British Patent Specification mentioned in the opening paragraph is freed at one of the two pinch seals from the metal envelope and the thermally conducting cement. The metal envelope of the other pinch seal was clamped on an aluminium plate of 500×200×2 mm, which with the interposition of thermally isolating material was disposed on a metal gauze. The bare pinch seal 12 floated above the plate. The lamp was made operative at design voltage. When a temperature variation no longer occurred, the temperature of the enveloped pinch seal was 214′ C. and that of the bare pinch seal was 228° C.

In comparison , the bare pinch seal 12 was then arranged in the cooling device as shown in FIG. 1, which was pressed in a similar manner on the aluminium plate. The lamp was re-energized. When a temperature variation no longer occurred, the temperature of the pinch seal with the original envelope of metal and thermally conducting cement was 214° C., whereas the pinch seal in the cooling device was only 175° C.

What is claimed is:

1. A device for cooling a pinch seal of an electric lamp comprising a lamp vessel enclosing an interior space and sealed by a pinch seal, and at least one current supply conductor extending longitudinally through said pinch seal, said device comprising a metal sleeve arranged for surrounding said pinch seal with a given clearance, along at least a portion of the length thereof, and a compliant thermally conductive mass arranged inside said sleeve for filling the clearance space between said pinch seal and said sleeve, said thermally conductive mass comprising metal fibers.

2. A device as claimed in claim 1, for cooling a pinch seal which has two generally parallel major faces, characterized in that said sleeve comprises a bottom part having side walls, and a detachable cover, said cover being substantially parallel to said major faces and having a layer of said fibers fixed to an inside cover surface.

3. A device as claimed in claim 1, characterized in that the metal fibers have a mutual coherence.

4. A device as claimed in claim 3, characterized in that said pinch seal has two major faces oppositely arranged, and metal fibers fill the clearance space between the major faces of the pinch seal and the metal sleeve.

5. A device as claimed in claim 1, 3 characterized in that the metal fibers are fixed in the metal envelope.

6. An electric lamp comprising a lamp vessel having at least one pinch seal, and at least one current supply conductor extending through a respective pinch seal, and a respective device for cooling each said respective pinch seal, said respective device comprising a metal sleeve arranged for surrounding said pinch seal with a given clearance, along at least a portion of the length thereof, and a compliant thermally conductive mass arranged inside said sleeve for filling the clearance space between said pinch seal and said sleeve, said thermally conductive mass comprising metal fibers.

7. An electric lamp as claimed in claim 6, having a pinch seal which has two generally parallel major faces, characterized in that said sleeve comprises a bottom part having side walls, and a detachable cover, said cover being substantially parallel to said major faces and having a layer of said fibers fixed to an inside cover surface.

8. An electric lamp as claimed in claim 6, characterized in that the metal fibers have a mutual coherence.

9. An electric lamp as claimed in claim 8, characterized in that said pinch seal has two major faces oppositely arranged, and the metal fibers fill the clearance space between the major faces of the pinch seal and the metal sleeve.

10. An irradiation apparatus suitable for receiving an electric lamp having a lamp vessel having a pinch seal, and at least one current supply conductor extending through said pinch seal, comprising a housing, and a device for cooling said pinch seal, said device comprising a metal sleeve arranged for surrounding said pinch seal with a given clearance, along at least a portion of the length thereof, said sleeve being secured to said housing, and a compliant thermally conductive mass arranged inside said sleeve for filling the clearance space between said pinch seal and said sleeve, said thermally conductive mass comprising metal fibers.

11. An irradiation apparatus as claimed in claim 10, suitable for receiving an electric lamp having a pinch seal which has two generally parallel major faces, characterized in that said sleeve comprises a bottom part having side walls, and a detachable cover, said cover being substantially parallel to said major faces and having a layer of said fibers fixed to an inside cover surface.

12. An irradiation arrangement as claimed in claim 10, characterized in that the metal fibers have a mutual coherence.

13. An irradiation arrangement as claimed in claim 12, characterized in that said pinch seal has two major faces oppositely arranged, and metal fibers fill the clearance space between the major faces of the pinch seal and the metal sleeve.

14. An irradiation arrangement as claimed in claim 12, characterized in that the metal fibers are fixed in the metal envelope.

15. An irradiation arrangement as claimed in claim 12, characterized in that the metal fibers are fixed in the metal envelope.

16. An irradiation arrangement as claimed in claim 6, characterized in that said pinch seal has two major faces oppositely arranged, and metal fibers fill the clearance space between the major faces of the pinch seal and the metal sleeve.

17. An electric lamp as claimed in claim 2, characterized in that said pinch seal has two major faces oppositely arranged, and the metal fibers fill the clearance space between the major faces of the pinch seal and the metal sleeve.

18. A device as claimed in claim 1, characterized in that the metal fibers are fixed in the metal envelope.

19. A device as claimed in claim 1, characterized in that said pinch seal has two major faces oppositely arranged, and metal fibers fill the clearance space between the major faces of the pinch seal and the metal sleeve.

20. An irradiation apparatus suitable for receiving an electric lamp whose lamp vessel has a pair of pinch seals, and at least one current supply conductor extending through each said pinch seals, comprising a housing, and a respective pair of devices for cooling each said pinch seals, said respective device comprising a metal sleeve arranged for surrounding each of said pinch seals with a given clearance, along at least a portion of the length thereof, said sleeve being secured to said housing, and a compliant thermally conductive mass arranged inside said sleeve for filling the clearance space between said pinch seal and said sleeve, said thermally conductive mass comprising metal fibers.

21. An irradiation apparatus as claimed in claim 20, suitable for receiving an electric lamp having a pair of pinch seals which each have two generally parallel major faces, characterized in that each said sleeve comprises a bottom part having side walls, and a detachable cover, said cover being substantially parallel to said major faces and having a layer of said fibers fixed to an inside cover surface.

* * * * *

UNITED STATES PATENT AND TRADEMARK OFFICE

CERTIFICATE OF CORRECTION

PATENT NO. : 4,678,959

DATED : July 7, 1987

INVENTOR(S) : Jan A.C. Mewissen

It is certified that error appears in the above-identified patent and that said Letters Patent is hereby corrected as shown below:

Claim 15, line 2 delete "12" insert --6--

Signed and Sealed this

Twenty-eighth Day of February, 1989

*Attest:*

DONALD J. QUIGG

*Attesting Officer*

*Commissioner of Patents and Trademarks*